United States Patent [19]

Bunger et al.

[11] Patent Number: 4,655,113

[45] Date of Patent: Apr. 7, 1987

[54] RYTHM RATE AND TEMPO MONITOR FOR ELECTRONIC MUSICAL INSTRUMENTS HAVING AUTOMATIC RHYTHM ACCOMPANIMENT

[75] Inventors: David A. Bunger, Cincinnati, Ohio; Walter Munch, Ft. Thomas, Ky.; Russell L. Withington, Cincinnati, Ohio

[73] Assignee: Baldwin Piano & Organ Company, Loveland, Ohio

[21] Appl. No.: 345,798

[22] Filed: Feb. 4, 1982

Related U.S. Application Data

[63] Continuation of Ser. No. 143,269, Apr. 24, 1980, abandoned.

[51] Int. Cl.[4] ..... G10F 1/00

[52] U.S. Cl. ..... 84/1.03; 84/DIG. 12

[58] Field of Search ..... 84/1.01, 1.03, DIG. 12, 84/464, 470 R, 484; 340/715, 753, 762, 771, 793

[56] References Cited

U.S. PATENT DOCUMENTS

| | | | |
|---|---|---|---|
| Re. 29,144 | 3/1977 | Bunger | 84/1.01 |
| 3,406,604 | 10/1968 | Stickley et al. | 84/484 |
| 3,467,959 | 9/1969 | Zazofsky | 340/384 |
| 3,534,649 | 10/1970 | Andersson | 84/484 |
| 3,541,916 | 11/1970 | Reid, Sr. | 84/484 |
| 3,554,073 | 1/1971 | Castilloux | 84/484 |
| 3,595,122 | 7/1971 | Brediceanu | 84/484 |
| 3,643,540 | 2/1972 | Rosenstock et al. | 84/484 |
| 3,691,896 | 9/1972 | Alessio | 84/484 |
| 3,743,758 | 7/1973 | Del Castillo | 84/484 |
| 3,760,681 | 9/1973 | Kennedy | 84/484 |
| 3,771,407 | 11/1973 | Leonard | 84/484 |
| 3,803,971 | 4/1974 | Del Castillo | 84/484 |
| 3,808,349 | 4/1974 | Baba et al. | 84/484 |
| 3,818,693 | 6/1974 | Allard | 84/484 |
| 3,905,269 | 9/1975 | Doerksen et al. | 84/470 |
| 3,942,404 | 3/1976 | Del Castillo | 84/484 |
| 3,976,994 | 8/1976 | Washizuka et al. | 340/791 |
| 3,991,648 | 11/1976 | Karpowicz | 84/470 |
| 3,996,833 | 12/1976 | Del Castillo | 84/484 |
| 4,012,979 | 3/1977 | Wemekamp | 84/1.01 |
| 4,014,167 | 3/1977 | Hasegawa et al. | 84/1.03 X |
| 4,018,131 | 4/1977 | Cannon | 84/484 |
| 4,033,220 | 7/1977 | Shibahara | 84/1.03 |
| 4,082,029 | 4/1978 | Rumer, Jr. et al. | 84/484 |
| 4,083,042 | 4/1978 | Kushin et al. | 340/753 |
| 4,089,246 | 5/1978 | Kooker | 84/1.03 |
| 4,090,355 | 5/1978 | Morohoshi | 84/484 X |
| 4,193,257 | 3/1980 | Watkins | 84/484 |
| 4,218,874 | 8/1980 | Ishida et al. | 84/484 |
| 4,241,342 | 12/1980 | Merriweather | 340/753 |
| 4,297,934 | 11/1981 | Imamura et al. | 84/1.03 |
| 4,299,154 | 11/1981 | Dietrich et al. | 84/1.03 |
| 4,336,534 | 6/1982 | Kumagai | 340/753 |
| 4,509,044 | 4/1985 | Yachida | 340/791 |

OTHER PUBLICATIONS

National Semiconductor, Linear Applications, vol. 1, 1976, pp. AN71-6, AN71-7.

*Primary Examiner*—Forester W. Isen
*Attorney, Agent, or Firm*—Frost & Jacobs

[57] ABSTRACT

A microprocessor-based processing system for monitoring the tempo rate and rhythm in an electronic musical instrument having an automatic rhythm accompaniment unit. In a first mode of operation, the monitor displays the tempo of the rhythm accompaniment unit in numeric characters representing the number of beats per minute. In a second mode of operation, the monitor displays a numerical 1 representing the down beat in a first display device, a numerical 2 representing the second beat in adjoining display device, and successively incremented numerical integers associated with successive beats in successive numerical display devices until all numerical integers associated with beats have been displayed, thereby producing a timing display having a motion effect for synchronizing the music being played with the rhythm accompaniment tempo.

11 Claims, 4 Drawing Figures

RYTHM RATE AND TEMPO MONITOR FOR ELECTRONIC MUSICAL INSTRUMENTS HAVING AUTOMATIC RHYTHM ACCOMPANIMENT

SUMMARY OF THE INVENTION

This is a continuation of Ser. No. 143,269, filed 4/24/80, now abandoned.

Metronomes providing audible beats corresponding to a particular time signature or tempo are well-known and have been the subject of substantial inventive effort. Such devices may be simple mechanical affairs producing a monotonous succession of evenly spaced clicks in synchronism with a desired tempo, or elaborate electronically implemented systems which produce syncopated rhythm accompaniment containing a multiplicity of percussive sounds.

Many of these metronome devices have included visibly sensible indicators for augmenting or supplementing the audible beats. For example, U.S. Pat. No. 3,818,693, issued June 25, 1974 to Frank L. Allard, discloses an electronic metronome having selectably energized spaced indicator lamps excited in a pattern corresponding to the pattern described by an orchestra leader's hand movements indicating standard best locations. An arrangement producing a similar effect is illustrated in U.S. Pat. No. 4,014,167, issued Mar. 29, 1977 to Ryozo Hasegawa et al., where electronically produced signals cause individual light emitting elements arranged in a linear array to become successively illuminated to produce a flowing light spot effect. U.S. Pat. No. 4,090,355, issued May 23, 1978 to Fumio Morohoshi describes an electronic metronome having a visual rhythm-displaying device consisting of a visual indicator including a pair of differently colored light emitting diodes for displaying down-beat and up-beat with different colors. Finally, U.S. Pat. No. 3,905,269, issued Sept. 16, 1975 to David P. Doerksen, et al., and U.S. Pat. No. 4,082,029, issued Apr. 4, 1978 to David Orville Rumer, Jr., et al. illustrate optical metronomes where an arrangement of spot-like or bar-like light sources successively illuminate printed musical notes at the proper tempo to indicate to the musician the time duration of each not to be played in the proper rhythmical sequence.

With all of these metronome arrangements, it is customary to set the desired tempo by ear or by reference to a roughly calibrated index scale associated with the tempo adjustment control. Often the musician cannot be certain of the tempo rate selected until the visual and/or audible indicators of the metronome are energized, which may be undesirable in performances where a rhythm accompaniment unit is used with an electronic musical instrument which often is muted until the performance begins. An audible or visible down-beat indicator may then be used to synchronize playing with the rhythm timing.

The present invention is directed to a microprocessor-based processing system for monitoring the tempo rate and rhythm of a metronome or metronome-like device, and more particularly with an electronic musical instrument of the type having means for automatically producing a preselected rhythm accompaniment having a desired tempo, such as that described and illustrated in U.S. Pat. No. Re. 29,144, reissued Mar. 1, 1977 to David A. Bunger, and assigned to Baldwin Piano & Organ Company. Fundamentally, in a first mode of operation, the present invention permits the performer to adjust the rhythm rate of a rhythm accompaniment unit visually in the absence of an audible rhythm output. In a preferred embodiment, with the rhythm accompaniment unit off, a calculator-type numerical readout displays the rhythm rate in numeric characters according to normal musical standards such as the number of quarter notes per minute. With this arrangement, the rhythm accompaniment unit can be turned on to a known tempo rate.

In a second mode of operation, the present invention may be used with the rhythm unit on as a timing indicator for player synchronization with rhythm. In the second mode of operation, a numerical character is flashed at specific timing intervals of the rhythm pattern. In a preferred embodiment, the timing indicator appears on a display consisting of four adjacent numeric character indicators. The down-beat indication displayed as a numeric 1 is displayed in the left most display device, the second beat is displayed in the adjacent display device as a numeric 2, etc., so that the effect of motion is imparted to the display. The processing circuitry of the present invention automatically interprets the time signature of the rhythm accompaniment produced by the rhythm accompaniment unit to provide the proper number of beats displayed as numeric characters per display sequence.

In a preferred embodiment, the rhythm rate and tempo monitor of the present invention is implemented by digital data processing means comprising a microprocessor. The fundamental tempo rate for the rhythm accompaniment unit is determined by the setting of a rate potentiometer which determines the charging time of an associated capacitor. Initially, the microprocessor, through appropriate instructions contained within an internal ROM, discharges the capacitor and begins a counting loop. The capacitor charges to a specific voltage which terminates the microprocessor counting loop. The count accumulated during the charging time provides a measure of the resistive setting of the rate potentiometer, and consequently the tempo rate of the rhythm accompaniment unit. When the rhythm unit is off, the count obtained from the rhythm potentiometer setting is converted to a tempo rate number by means of a look-up table contained within the microprocessor ROM. This number is then displayed on the numeric character display as the appropriate number of quarter notes per minute. When the rhythm unit is on, a clock pulse, related to the rhythm potentiometer setting, is gated to the rhythm unit, and operates an address counter which is used to generate the rhythm pattern. Using the address outputs from the address counter, the microprocessor sequentially displays the appropriate numeric character in the proper display device. In the preferred embodiment illustrated, the display devices are blanked between successive character displays to provide a pleasing scanned timing indicator.

Other features of the invention will become apparent from the detailed description which follows:

DETAILED DESCRIPTION

Figure 1:
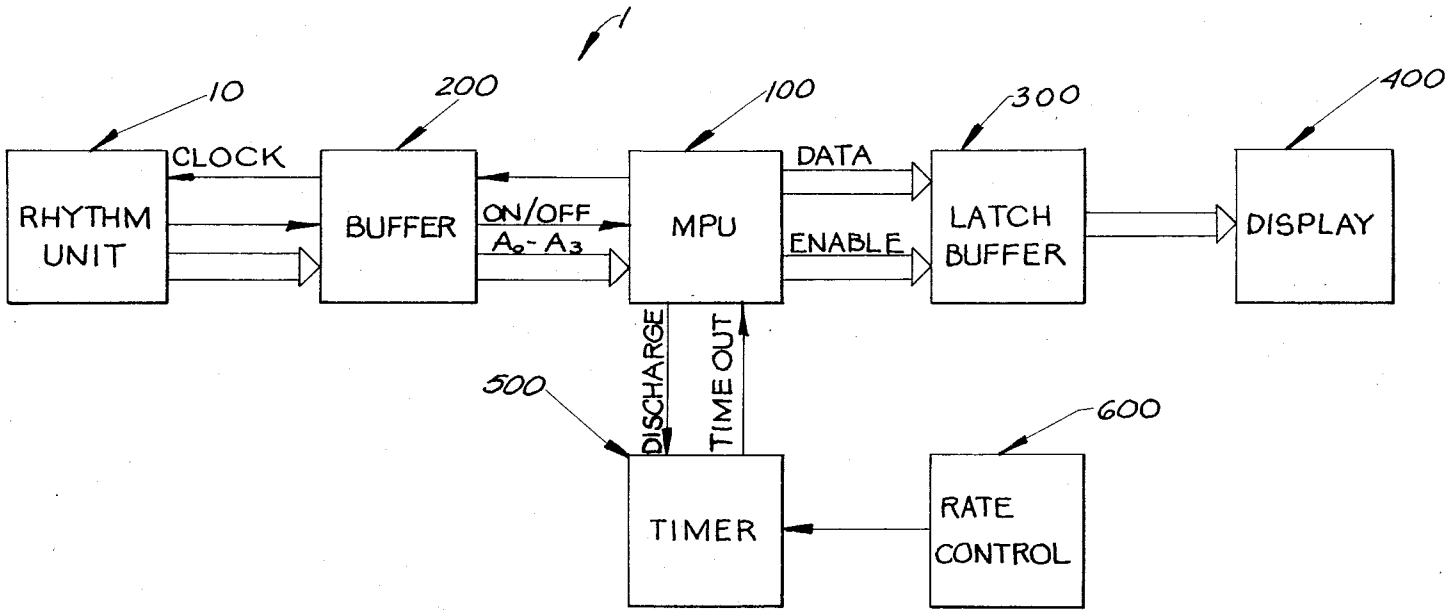
FIG. 1 is a general block diagram of the rhythm rate and tempo monitor of the present invention.

The rhythm rate and tempo monitor of the present invention, shown generally at 1 in FIG. 1, is configured to process rhythm and tempo information from rhythm unit 10, such as that described and illustrated in aforementioned U.S. Pat. No. Re. 29,144 through microprocessor unit (MPU) 100, and display rate and tempo information on numeric character display 400. Buffer 200 conditions signals passing between rhythm unit 10 and MPU 100, while latch buffer 300 temporarily stores data from MPU 100 for display by display 400. A timer 500 provides a time base for rate control 600 to establish a count within MPU 100 corresponding to the frequency of tempo pulses produced by rhythm unit 10.

Figure 2:
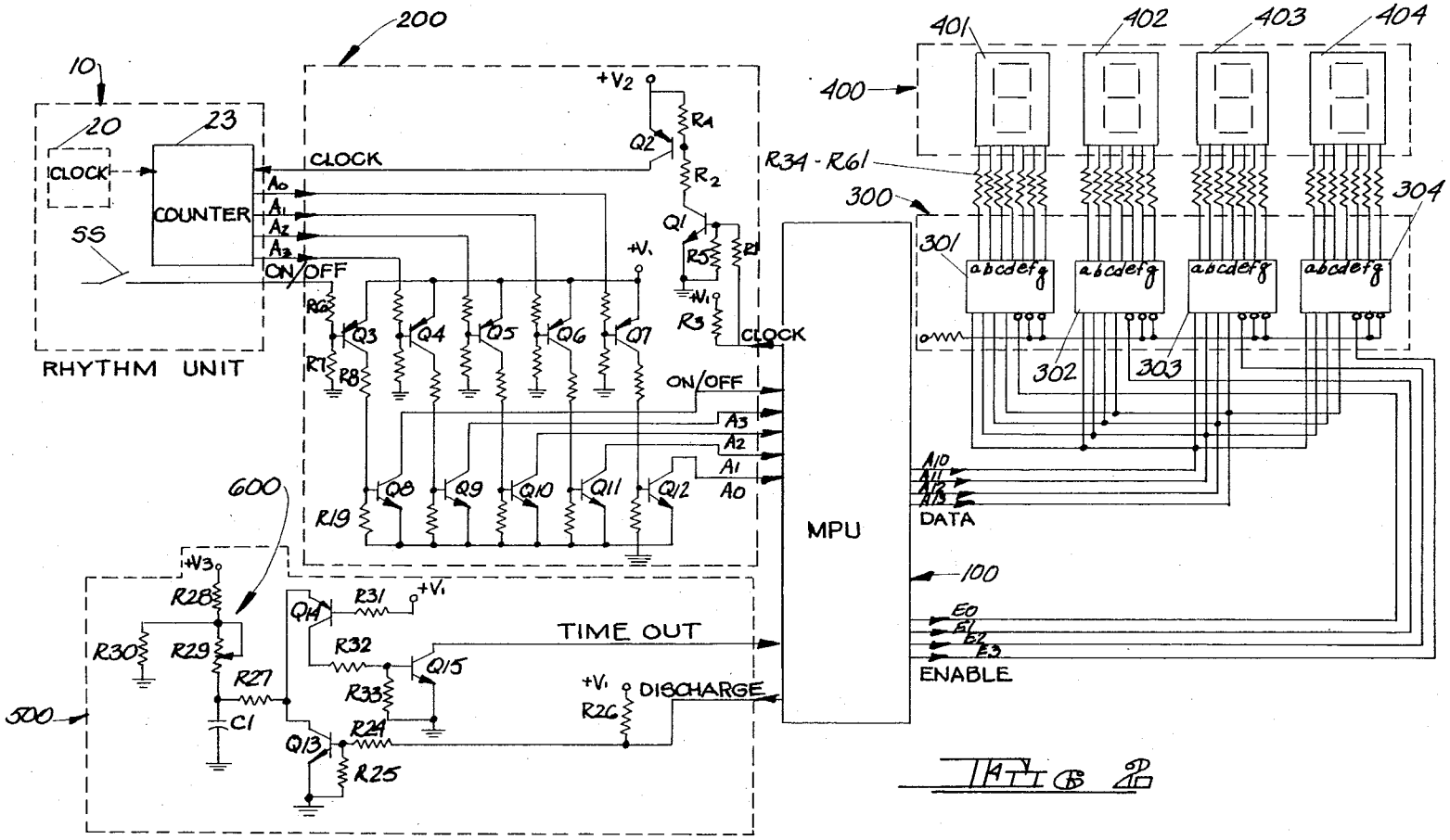
FIG. 2 is a general schematic diagram of the rhythm rate and tempo monitor of the present invention.

The preferred implementation of the rhythm rate and tempo monitor 10 is illustrated in FIG. 2, Rhythm unit 10, which may be of the type illustrated in U.S. Pat. No. Re. 29,144, includes an adjustable rhythm clock oscillator 20 driving a resettable counter 23 which provides a plurality, in this case four, address outputs $A_0$-$A_3$ which are used in rhythm unit 10 to address a ROM containing particular rhythm information which may be contained in MPU 100 or as a separate memory unit. In the present embodiment, the clock input from rhythm clock oscillator 20 to counter 23 has been disconnected, and replaced by an external CLOCK signal produced by MPU 100. In general, counter 23 counts in a binary manner and provides a four bit binary word appearing on address lines $A_0$-$A_3$ whose value corresponds to particular time in the measure. Since the four binary bits have sixteen different possible values, the measure can be divided into sixteen discrete time intervals. This binary address activates a section of the ROM which, depending upon the information stored in the ROM, selects a particular rhythm mode as is well understood in the art.

In the present invention, the external CLOCK signal from MPU 100 causes counter 23 to count in a binary manner, and produce the four bit address output $A_0$-$A_3$. Rhythm unit 10 also supplies a signal designated ON/-OFF supplied through start switch SS to provide a control signal designating when rhythm unit 10 is producing an audible output (ON mode) or when the audible output of the rhythm is inhibited (OFF mode). In either mode, address lines $A_0$-$A_3$ will continue to change state for as long as the CLOCK signals are appled to counter 23.

Buffer 200 provides level translation and isolation between rhythm unit 10 and MPU 100. The CLOCK signals from MPU 100 are applied through a resistor R1 to the base of transistor Q1. The collector of transistor Q1 is connected through resistor R2 to the base of transistor Q2. The emitter of transistor Q2 is connected to supply voltage $+V_2$, while the open collector of this transistor forms the output line to counter 23. A pull-up resistor R3 may also be provided between the CLOCK output of MPU 100 and supply voltage $+V_1$ as required. In a similar manner, each of the address lines $A_0$-$A_3$ and the ON/OFF signal lines is connected from counter 23 through corresponding transistor stages to the appropriate port input of MPU 100. For example, the ON/OFF signal from rhythm unit 10 is applied through resistor R6 to the base of transistor Q3. The emitter of transistor Q3 is tied to supply voltage $+V_1$, While the collector is connected through resistor R8 to the base of transistor Q8. The open collector of transistor Q8 forms the appropriate port input to MPU 100. The remaining translation isolation stages for address lines $A_0$-$A_3$ are constructed in a similar manner as illustrated in FIG. 2.

Timer 500 is responsive to the DISCHARGE signal from an output port of MPU 100, which is connected through resistor R24 to the base of grounded emitter transistor Q13. A pull-up resistor R26 may also be used as required with the particular MPU device. The collector of transistor Q13 is connected to the emitter of transistor Q14 and through resistor R27 to timing capacitor C1, the other end of which is connected to ground. C1 is also connected to supply voltage $+V_3$ through fixed timing resistor R28 and variable timing resistor R29 which forms rate control 600 as will be explained in more detail hereinafter. An additional resistor R30 is connected from the junction of R28 and R29 to ground to complete an RC timing network.

The base of transistor Q14 is connected through resistor R31 to supply voltage $+V_1$, while the collector is connected through resistor R32 to the base of transistor Q15. The emitter of transistor Q15 is connected to ground, while the open collector forms the TIME OUT signal supplied to MPU 100.

It will be observed that with no signal applied to the DISCHARGE line, transistor Q13 will be turned on through pull-up resistor R26 to clamp capacitor C1 to ground. At the same time, no signal appears on the TIME OUT line. However, when the DISCHARGE line goes low, transistor Q13 is turned off, unclamping capacitor C1 and permitting it to charge through timing resistances R28 and R29 toward supply voltage $+V_3$. When the voltage on the capacitor as supplied through resistor R27 to the emitter of transistor Q14 reaches a particular value, as determined by the passive component values and voltage thresholds of the active devices, transistor Q14 turns on, permitting transistor Q15 to turn on, and a low signal to be applied on the TIME OUT line. Consequently, timer 600 insures that a signal will be produced on the TIME OUT line a period of time after a signal appears on the DISCHARGE line as determined by the setting of potentiometer R29 forming rate control 600. As will be explained in more detail hereinafter, rate control 600 sets the tempo rate for rhythm unit 10.

In a preferred embodiment, MPU 100 comprises a MK3870 single-chip microcomputer device manufactured by Mostek, Inc. This particular device comprises a complete eight bit microcomputer on a single MOS integrated circuit. The MK3870 executes the Fairchild F8 instruction set, and includes 2048 bytes of internal ROM, 64 bytes of scratch-pad RAM, 32 bits of I/O, and several usable internal registers. In the present invention, the input signals listed above have been assigned to Port 0, while the output lines have been assigned to Port 1. It will be understood that the particular bit assignment for each input or output line, as well as the port assignment is somewhat arbitrary, and may vary among various device types or programming methods.

As will be explained in more detail hereinafter, MPU 100 processes information appearing on address lines $A_0$-$A_3$, ON/OFF, and TIME OUT, to produce information appearing on DATA and ENABLE lines corresponding to particular numeric characters which are to be displayed on display 400 in a specific time sequence. For example, in a first mode of operation, the present invention permits the performer to adjust the rhythm rate of rhythm unit 10 by means of rate control 600 with the rhythm unit output in the OFF mode such that display 400 displays the rhythm rate in numeric characters according to normal musical standards such as the number of quarter notes per minute. In a second mode of operation, the present invention is utilized with rhythm unit 10 in the ON mode such that a numerical character is flashed on display 400 at specific timing intervals of the rhythm pattern. For example, the downbeat indication displayed as a numeric 1 is displayed in the left-most display device 401, the second beat is displayed in the adjacent display device 402 as a numeric 2, etc., so that the effect of motion is imparted to the display. The processing contained within MPU 100 automatically interprets the time signature of the rhythm accompaniment produced by rhythm unit 10 to provide the proper number of beats displayed as numeric characters for each display sequence. The construction and operation of seven segment display devices 401-404 is conventional and need not be explained in detail.

To facilitate transfer of data from MPU 100 to display 400, a latch buffer 300 is utilized consisting of one latch register 301-304 for each numeric character display 401-404. Registers 301-304, which may comprise Motorola 34511 latching BCD driver devices, produce a seven segment display command on output lines a-g when the appropriate BCD input command appears on DATA lines $A_{10}$-$A_{13}$ and the ENABLE line $E_0$-$E_3$ associated with each register 301-304 goes low. Consequently, when the BCD output 0001 appears on DATA lines $A_{10}$-$A_{13}$, and ENABLE line $E_0$ goes low, the appropriate seven segment outputs a-g will be enabled to illuminate the corresponding segments on display 401 to display a numeric 1. As required, current limiting resistors designated R34-R61, may be provided between registers 301-304 and numeric character display devices 401-404 as illustrated in FIG. 2.

Figure 3A:
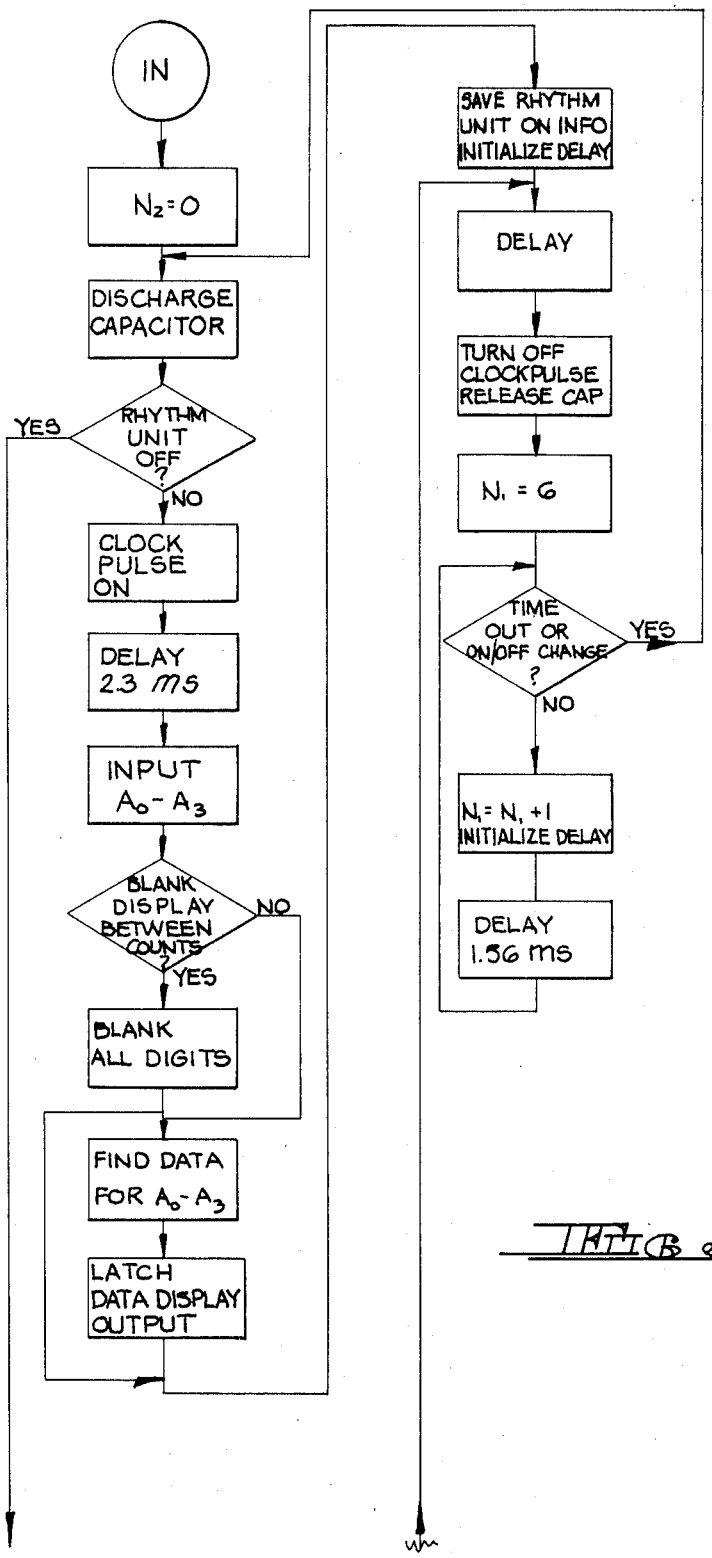
FIGS. 3A–3B is a flow diagram illustrating the processing for microprocessor 100.
Figure 3B:
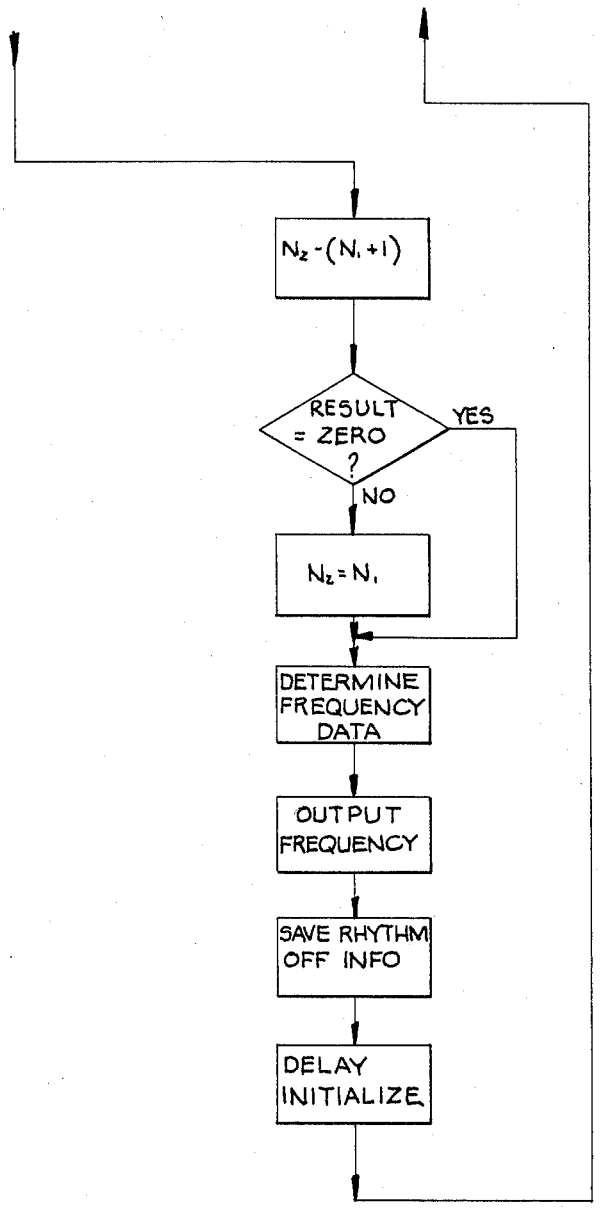

The flow diagram for the program stored in ROM contained in MPU 100 is illustrated in FIGS. 3A-3B. It will be assumed for purposes of discussion herein, that on power-up, an initial pass is made through the program to set internal functions at appropriate initial values. For example, the accumulator is cleared and an internal MPU register designated $N_2$ corresponding to the previous pot register count is set to 0.

A high output continues to be produced on the DISCHARGE line, which discharges capacitor C1 by clamping it to ground. A test is then performed for rhythm unit 10 by means of the status of the ON/OFF signal to determine if the rhythm unit is producing on audible output. If this signal indicates that the rhythm unit 10 is in the off mode so that no audible outputs are being produced, the positive branch in FIG. 3A will be followed, such that the processing proceeds in the first mode described hereinabove where the appropriate number of quarter notes per minute or tempo rate is to be displayed on numeric display 400.

As noted above, it will be assumed that an initial pass has been made through the processing, and a value established for $N_2$ (previous pot register count) corresponding to the tempo rate. Furthermore, it will be assumed that in the initial pass a value has been established for a parameter $N_1$ corresponding to the present tempo rate. The value $N_1$ is incremented by 1, and subtracted from the value $N_2$ if the result is zero and the processing continues; however, if the result is not zero, $N_2$ is set equal to $N_1$ and the processing continues. This operation forms a hysteresis loop which permits rate control 600 to be more easily adjusted. That is, the adjustment of rate control 600 as implemented by potentiometer R29 is less sensitive.

The tempo rate corresponding to the value of $N_2$ may then be directly displayed on display 400 as a two or three digit number lying in the range 38–265 (corresponding to the usual range of quarter notes per minute). The tempo rate display data may be determined from the value of $N_2$ by means of two or three digit values stored in a look-up table, or in the embodiment described may be calculated algebraically using an algorithm employing the following relationship: tempo rate display data$=N_2(-1.028)+301$. Consequently, when the value of the previous pot register count $N_2$ has a value of 180, for example, the corresponding displayed tempo rate determined either from the look-up table or by calculation will be 115 beats per minute, display 400 operating to ignore any fractional remainder. This temporate display data is transferred to the MPU output port and appears as specific data and enable signals corresponding to the actual rhythm rate. This information is then displayed as a two or three digit numeric character number on numeric display devices 402, 403 and 404. It will be observed that in general, this display will lie within the region 38–265, or a similar region corresponding to the usual range of quarter notes per minute for the type of rhythm units generally utilized. The information as to whether rhythm unit 10 is off or on is then saved, and a delay may be initialized to balance the length of the various processing loops as required. This completes this branch of the flow processing which selects a particular frequency associated with the tempo rate and displays it on display 400.

Following this linear program routine, the processing returns to the main processing branch. Inasmuch as the processing within MPU 100 is proceeding at a relatively high rate, it may be necessary to introduce an additional delay to insure that capacitor C1 has completely discharged. Following this delay, a transition is produced on the CLOCK line, and the DISCHARGE signal goes low to unclamp capacitor C1, and permit it to begin charging through timing resistors R28 and R29. As described hereinabove, the charging rate is determined by the setting of potentiometer R29 which forms rate control 600. At the same time, MPU 100 begins an internal counting sequence to produce an elapsed time count value $N_1$, beginning at a start count value of 6 corresponding to time lapsed outside the count loop. This counting will continue until the voltage on capacitor C1 reaches the predetermined threshold value on the collector of transistor Q14 as described hereinabove, whereupon the TIME OUT line will go low. In other words, if the TIME OUT line has not changed, the processing will follow the negative branch illustrated in FIG. 3A wherein the count value associated with $N_1$ continually increments at regular intervals as determined by the amount of delay introduced into the timing loop, for example 1.56 milliseconds in the preferred embodiment illustrated. As noted, this timing loop continues to increment $N_1$ until the TIME OUT from timer 500 occurs. Consequently, a count is produced proportional to the time required for C1 to charge at a known rate to a known value, or in other words a count proportional to the setting of potentiometer R29 corresponding to rate control 600. It is this value $N_1$ which is used as described hereinabove to determine the frequency or tempo rate to be displayed on display 400.

When the TIME OUT signal to MPU 100 goes low, the processing exits on the positive branch, and returns control to the upper portion of the flow chart illustrated in FIG. 3A so that the entire procedure described hereinabove may be repeated. It will be observed that control may also be returned to the main program branch in the event that a change occurs in the ON/OFF signal associated with start switch SS. This permits the system to initialy respond to activation of rhythm unit 10 so that the timing indicators will be immediately synchronized with the rhythm tempo produced by rhythm unit 10, in the second mode of operation to be described.

In the second mode of operation described hereinabove, wherein a succession of numerical characters are flashed at specific timing intervals of the rhythm pattern, rhythm unit 10 will be in the ON mode, so that the negative branch will be followed in the upper portion of the flow chart of FIG. 3A. The CLOCK signal from MPU 100 undergoes a transition, causing counter 23 of rhythm unit 10 to advance its count, and produce a different combination of signals on output address lines $A_0$-$A_3$. A delay may also be introduced as required to insure that the outputs from counter 23 have stabilized. The counter address information $A_0$-$A_3$ is then transferred to the input port of MPU 100. In the preferred embodiment illustrated, it has been found desirable to operate the character displays associated with each individual digit at approximately a 50% duty cycle in order to provide a pleasing left-to-right flow of display information. Consequently, the internal system processing contains the provision for blanking display devices 401-404 between numeric character digit displays by alternately blanking all digits and displaying a single digit according to the counter address information, for example by monitoring the state of address line $A_1$. For example, if all digits are to be blanked, the positive branch illustrated in FIG. 3A is taken, which directs the processing to the linear program routine described hereinabove where a count associated with the setting of rate control 600 is produced. On the other hand, when the negative branch is followed, a particular numeric character is to be displayed on a corresponding one of display devices 401-404.

As described hereinabove, the address information $A_0$-$A_3$ obtained from counter 23 represents the particular beat in a measure, with changes in the state of counter 23 occurring at the rhythm tempo rate. For example, the counting sequence for 4/4 time may proceed 1-2-3-4, 1-2-3-4, etc. Since the numeral 1 is always associated with the down beat, the processing of the present invention causes a numeric 1 to be displayed on the leftmost display device 401 of display 400. All displays are then blanked, counter 23 increments to produce a numerical 2 output, and the numerical 2 is displayed in the adjacent character display 402 as a numeric 2. After this data has been latched into latch buffer 302 for display by display device 402, the processing begins a new loop, which causes a further CLOCK signal to be produced, incrementing counter 23 such that a numeric 3 is produced to latch 303 and displayed on device 403. Finally, the counter 23 is incremented by an additional CLOCK signal, which causes a numeric 4 to be latched into latch buffer 304 and displayed on display device 404. The sequence then repeats, with each display device displaying a numeric character in turn, with a corresponding blank between displays. In this manner, a pleasing left-to-right flowing effect is produced to assist the performer.

It will be observed that various types of time signatures may be implemented in the present invention, depending on the counting sequence of counter 23. For example, a four count sequent produces 4/4 time, a three count sequence produces 3/4 time, a two count sequence produces 2/4 time, etc. In addition, other types of time signatures such as 6/8 may be implemented by causing the numerals 1,2 and 3 to appear successively on display devices 401-403, respectively, while the counts 4, 5 and 6 are repeated successively in the same display devices. This permits both the major and minor down beat occurring on the first and fourth beats, respectively, to appear in the first character display device 401. Other time signatures, such as 5/4 and the like may be implemented similarly.

It will be understood that various changes in the details, materials, steps and arrangements of parts, which have been herein described and illustrated in order to explain the nature of the invention, may be made by those skilled in the art within the principle and scope of the invention as expressed in the appended claims.

The embodiments of the invention in which an exclusive property or privilege is claimed are as follows:

1. In an electronic musical instrument of the type having means for automatically producing a preselected rhythm accompaniment having a desired tempo and an analog tempo rate control for establishing said desired tempo, the improvement in combination therewith comprising display means including a plurality of numerical display devices for displaying said tempo in numeric characters, digital data processing means for producing a rate determined by said rate control to establish said desired tempo, means responsive to said processing means for causing said display means to display said tempo in numeric characters representing the number of beats per minute, said processing means including hysteresis means for reducing the sensitivity of said rate control when changing tempos so as to reduce jitter in the display of said numeric characters on said display means.

2. The musical instrument according to claim 1 wherein said digital data processing means comprises a microprocessor.

3. In an electronic musical instrument of the type having means for automatically producing a preselected rhythm accompaniment having a desired tempo, a tempo rate control for establishing said desired tempo, display means comprising a plurality of numerical display devices for successively displaying a numerical 1 representing the downbeat of a measure of music in a first display device, a numerical 2 representing the second beat of the measure in an adjoining display device, and successively incremented numerical integers associated with successive beats in the measure in successive adjoining numerical display devices until all numerical integers associated with beats in the measure have been displayed; and digital data processing means for causing said display to successively display, at a rate determined by the setting of said rate control, a numerical 1 representing the downbeat of the measure in said first display device, a numerical 2 representing the second beat of the measure in said adjoining display device, and successively incremented numerical integers associated with successive beats in the measure in said successive numerical display devices, until all numerical integers associated with beats in the measure have been displayed.

4. The musical instrument according to claim 3 wherein said digital data processing means comprises a microprocessor.

5. The musical instrument according to claim 3 wherein said digital data processing means includes means for blanking all display devices so that each of said numerical characters is displayed for less than a full beat.

6. The musical instrument according to claim 3 including means for synchronizing said displaying means with said accompaniment tempo such that said first numerical character is displayed coincidentally with the down beat initiating said rhythm accompaniment output.

7. In an electronic musical instrument of the type having means for automatically producing a preselected rhythm accompaniment having a desired tempo, said means including a counter means producing in response to an input clock signal an output address representative of the state of said counter means and corresponding to a particular beat in a measure of music, the improvement in combination therewith comprising:

a tempo rate control for establishing said desired tempo;

visible display means comprising a plurality of numerical display devices arranged in adjoining relationship for successively displaying a numerical 1 representing the down beat of the measure in a first display device, a numerical 2 representing the second beat of the measure in an adjoining display device, and successively incremented numerical integers associated with successive beats in the measure in successive adjoining numerical display devices, until all numerical integers associated with beats in the measure have been displayed; and digital data processing means for causing said display to successively display, at rate determined by the setting of said rate control, a numerical 1 representing the down beat of the measure in said first display device, a numerical 2 representing the second beat of the measure in said adjoining display device, and successively incremented numerical integers associated with successive beats in the measure in said successive numerical display devices, until all numerical integers associated with beats in the measure have been displayed.

8. The musical instrument according to claim 7 wherein said digital data processing means includes means for displaying a particular one of said numerical characters in response to a unique output address of said counter means.

9. The musical instrument according to claim 7 wherein said digital data processing means includes timing means for producing said clock signal.

10. The musical instrument according to claim 9 wherein said timing means comprises capacitor means, variable resistor means connected between said capacitor means and a source of voltage, means for causing said capacitor to begin charging at a rate determined by the setting of said variable resistor means, and means for detecting when the voltage on said capacitor reaches a predetermined value to produce said clock signal.

11. In an electronic musical instrument of the type having means for automatically producing a preselected rhythm accompaniment having a desired tempo and a tempo rate control for establishing said desired tempo, the improvement in combination therewith comprising display means including a plurality of numerical display devices for displaying said tempo in numeric characters, digital data processing means for producing a rate determined by said rate control to establish said desired tempo, and means repsonsive to said processing means for causing said display means to display said tempo in numeric characters representing the number of beats per minute, said rhythm accompaniment means including means for producing an audible output and means for inhibiting said audible output and said digital data processing means including means for permitting said display only when said audible output is inhibited.

* * * * *